US005746413A

United States Patent [19]

Goloff

[11] Patent Number: 5,746,413

[45] Date of Patent: May 5, 1998

[54] FLUID METERING VALVE

[75] Inventor: Charles N. Goloff, Secor, Ill.

[73] Assignee: Caterpillar Inc., Peoria, Ill.

[21] Appl. No.: 641,664

[22] Filed: May 1, 1996

[51] Int. Cl.[6] ..... F16K 31/06

[52] U.S. Cl. ..... 251/129.15; 417/466

[58] Field of Search ..... 251/129.15, 129.07; 417/466, 469, 471, 496

[56] References Cited

U.S. PATENT DOCUMENTS

| | | | |
|---|---|---|---|
| 1,479,978 | 1/1924 | Bobrick et al. | 417/496 |
| 1,556,149 | 10/1925 | Koppelman | 417/496 |
| 1,726,402 | 8/1929 | Lurcott | 417/496 |
| 3,925,988 | 12/1975 | Kelley | 417/471 |
| 4,522,372 | 6/1985 | Yano | 251/129.15 |
| 4,869,346 | 9/1989 | Nelson . | |
| 5,174,336 | 12/1992 | Casey et al. | 251/129.15 |

*Primary Examiner*—Marguerite McMahon

*Attorney, Agent, or Firm*—John W. Grant; J. W. Burrows

[57] ABSTRACT

A fluid metering valve adaptable for outputting a fixed volume of lubricating oil from a diesel engine into an engine fuel system includes a sleeve slidably disposed in a body and a piston valve slidably disposed within the sleeve. A spring resiliently biases the sleeve to a default position blocking communication between a chamber and an outlet and the piston valve to a default position communicating an inlet with the chamber. The default position of the sleeve is established by a annular member resiliently biased into engagement with the body by another spring while the default position of the piston valve is established by another annular member urged into engagement with the body by a third spring. Movement of the piston valve toward the chamber by an input force such as a force motor initially blocks communication between the inlet and the chamber and subsequently increases the fluid pressure in the chamber to a level sufficient for moving the sleeve away from the chamber to establish communication between the outlet so that continued movement of the piston valve outputs a fixed volume of fluid.

11 Claims, 1 Drawing Sheet

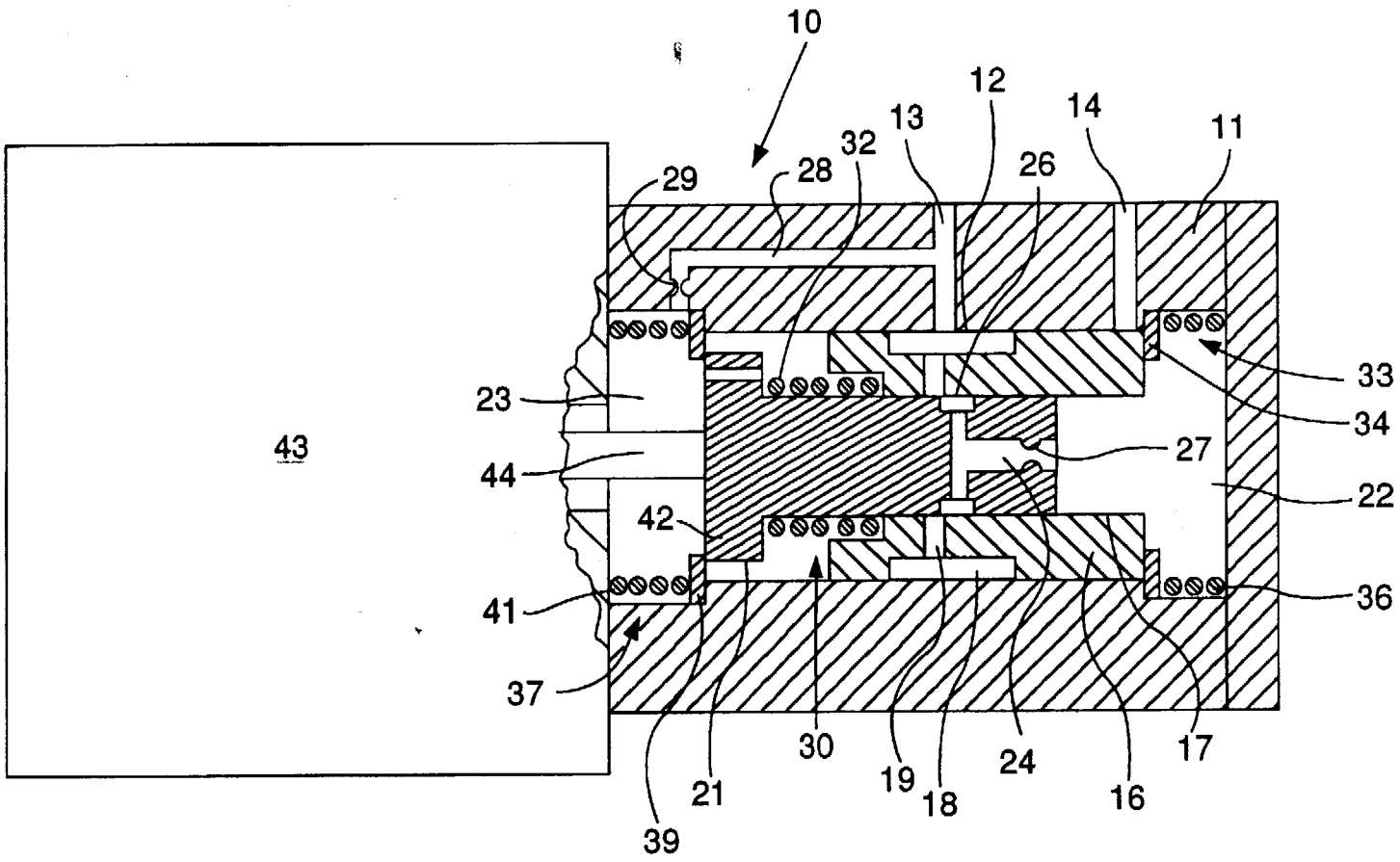
10
11
12
13
14
16
17
18
19
21
22
23
24
26
27
28
29
30
32
33
34
36
37
39
41
42
43
44

FLUID METERING VALVE

TECHNICAL FIELD

This invention relates generally to fluid metering valves and more particularly to one which outputs a fixed fluid volume per valve actuation.

BACKGROUND ART

Some diesel engines have an apparatus for increasing the time between oil change intervals so that down time of the machine is reduced. Typically those apparatuses periodically remove a small volume of used lubricating oil from the lubricating oil system, mix such used oil with the diesel fuel so that it is eventually burned during normal engine operation, and replenishing the volume of lubricating fluid in the lubricating system when the level is reduced to a predetermined level. Since the lubricating oil generally has a higher BTU rating than the diesel fuel one of the design parameters is that the apparatus be capable of precisely metering very small amounts of used lubricating oil for mixing with the fuel so as to not provide a mixture overly rich with lubricating oil.

While the current systems employ reliable electronic controllers for controlling the actuation of the metering valve, one of the problems encountered is that of the metering valve consistently delivering the designed quantity of lubricating oil under all operating conditions of the engine. To offset the inconsistency in the delivered amount of oil the control scheme for the metering valve generally requires several additional components to support its operation and/or sensors to insure that the proper amount of lubricating oil is dispensed into the fuel. Some of the factors that greatly influence the reliability of the metering valve consistently delivering the designed quantity of oil is the pressure, viscosity, temperature, and the amount of contaminants of the used oil delivered to the metering valve. For example, most of the apparatuses use the pressurized oil from the lubricating system as the source of oil to the metering valve. The pressure of the lubricating system can vary drastically during normal operation of the engine and thereby greatly affects the amount of lubricating oil delivered over a period of time. Likewise, the viscosity or weight of the oil itself can be different in different engines depending on the operating environment. The temperature of the oil in each engine can vary over a range sufficient to influence the viscosity of the lubricating oil. Finally, while the apparatus is designed to reduce the contaminants in the lubricating oil, the amount of contaminants still increases over an extended period of time.

Thus in view of the above, it would be desirable to have a metering valve which is not substantially affected by the above noted factors so that a precise, controlled volume of oil is delivered to the fuel system each time the metering valve is actuated and which does not require additional valves to support its operation. The amount of lubricating oil delivered to the fuel system could then be precisely controlled simply by controlling the number of times the metering valve is actuated per unit of time.

The present invention is directed to overcoming one or more of the problems as set forth above.

DISCLOSURE OF THE INVENTION

In one aspect of the present invention a fluid metering valve for outputting a fixed volume of fluid for each time the valve is actuated includes a body having a bore therein and an inlet and an outlet opening into the bore, a cylindrical sleeve slidably disposed within the bore and having a radial port continuously communicating with the inlet, a valve piston slidably disposed within the sleeve and cooperating therewith to define a chamber in the body, first means for resiliently biasing the sleeve to a default position blocking the chamber from the outlet and for biasing the piston to a default position communicating the radial port with the chamber, second means for resiliently establishing the default position of the sleeve, and third means for establishing the default position of the piston valve.

BRIEF DESCRIPTION OF THE DRAWINGS

The SOLE FIGURE is a cross sectional view of an embodiment of the present invention.

BEST MODE FOR CARRYING OUT THE INVENTION

A fluid metering valve 10 for outputting a fixed volume of fluid each time it is actuated includes a composite body 11 having a bore 12 therein and an inlet 13 and an outlet 14 opening into the bore. A cylindrical sleeve 16 is slidably disposed within the bore 12 and has a bore 17 extending actually therethrough, an annular groove 18 in the outer periphery continuously communicating with the inlet 13, and a pair of radial ports 19 communicating the annular groove with the bore 17. A piston valve 21 is slidably disposed within the bore 17 and cooperates with the sleeve 16 to define a pair of chambers 22, 23 in the body at opposite ends of the sleeve. A passageway 24 communicates an annular groove 26 in the piston valve with the chamber 22 and has an orifice 27 defined therein. A passage 28 in the body 11 communicates the inlet 13 with the chamber 23 through an orifice 29. Alternatively, the passage 28 and the orifice 29 can be formed in the sleeve by connecting the groove 18 with the left end of the sleeve.

A means 30 is provided for resiliently biasing the sleeve 16 to a default position blocking the chamber 22 from the outlet and for resiliently biasing the piston valve 21 to a default position communicating the chamber 22 with the ports 19. The means 30 can include for example a spring means for biasing the piston valve toward the chamber 22 and the sleeve away from the chamber 22. In this embodiment the spring means includes a spring 32 is disposed between the sleeve and the piston valve.

Another means 33 is provided for establishing the default position of the sleeve. The means 33 includes an annular member 34 engaging the body and disposed to be engaged by the sleeve, and another spring 36 disposed between the body and the annular member 34 in a preloaded condition to resiliently resist movement of the sleeve toward the chamber. The preload of the spring 36 is greater than the biasing force exerted on the sleeve by the spring 32.

Another means 37 is provided for establishing the default position of the piston valve. In this embodiment the means 37 includes another annular member 39 engaging the body and disposed to be engaged by the piston valve, and another spring 41 disposed between the body and the annular member 39 in a preloaded condition to resiliently resist movement of the piston valve toward the chamber 23.

The valve piston 21 includes an annular flange 42 urged into engagement with the annular member 39 by the spring 32.

A force motor 43 is connected to the body 11 for providing the motive force for urging the piston valve 21 toward the chamber 22. In this embodiment, the force motor is a solenoid having a plunger 44 extending into the chamber 23 in axial alignment with the piston valve 21. Alternatively, the force motor can be any mechanical or electrical devise capable of inputting a mechanical force against the piston valve 21 in response to an electrical, mechanical, manual, or fluid input.

Industrial Applicability

In use, the fluid metering valve 10 is designed to receive pressurized fluid at the inlet 13 from a source of pressurized fluid such as the lubricating system of a diesel engine while the outlet 14 is connected to, for example, the fuel system of the engine With the force motor 43 deenergized, the springs 32, 36, and 41 initially serve to position the sleeve 16 and piston valve 21 in the default position shown. At such positions, the pressurized fluid in the inlet 13 passes through the annular groove 18, radial ports 19, annular groove 26, passageway 24, and orifice 27 into the chamber 22. The pressurized fluid in the inlet 13 also passes through the passage 28 and orifice 29 into the chamber 23. Since the outlet 14 is blocked from the chamber 22, the pressure generated forces acting on the right ends of the sleeve 16 and the piston valve 21 are balanced by the pressure generated forces acting on the left end of the sleeve and piston valve.

Actuation of the metering valve is initiated by energizing the force motor 43 to apply an input force to the piston valve. This initially moves the piston valve 21 rightward from the default position toward the chamber 22 with a small amount of fluid in chamber 22 being forced to exit through the annular groove 26 and the ports 19. After communication between the annular groove 26 and the ports 19 is blocked, further rightward movement of the piston valve pressurizes the trapped volume of fluid in the chamber 22. When the pressure therein exceeds the pressure in the chamber 23 by a value determined by the spring 33, the pressure induced force acting on the right end of the sleeve 16 compresses the spring 33 and the sleeve 16 moves leftward from its default position simultaneously with the rightward movement of the piston valve 21 until communication is established between the chamber 22 and the outlet. The piston valve now moves rightward relative to the sleeve to output a fixed volume of fluid from the chamber 22 through the outlet 14. In this embodiment, the volume of fluid expelled from the chamber 22 is limited by the stroke of the force motor 43, and the combination of the relationship between the outlet 14 and the end of the sleeve 16 and between the radial ports 19 and the annular groove 26. Alternatively, the distance between the flange 42 and the end of the sleeve can be selected so that the volume of fluid expelled from the chamber 22 is controlled by contact therebetween rather than the stroke of the force motor.

The process of returning the sleeve and piston valve to their default positions to refill the chamber 22 is initiated by deenergizing the force motor. Initially the spring 33 simultaneously moves the sleeve rightward toward the chamber 22 and the piston valve leftward away from the chamber 22. Communication between the ports 19 and the annular groove 26 remain blocked during this initial movement of the sleeve and piston valve so that the volume of fluid in the chamber remains substantially constant. When the sleeve engages the washer 36, the pressure in the chamber 22 decreases upon further leftward movement of the piston valve thereby allowing the pressurized fluid in the chamber 23 to now exert a force against the sleeve which in combination with the force of the spring 32 is sufficient to compress the spring 36 so that simultaneous separating movement of the sleeve and the piston valve continue until communication is established between the port 19 and the annular groove 26. This allows pressurized fluid from the inlet 13 to enter the chamber 22. As the pressure in the chambers 22 and 23 equalize the spring 36 moves the sleeve leftward allowing the chamber to be refilled with fluid. Eventually the annular member 34 engages the body and the piston valve engages the annular member 39 thereby positioning the piston valve and the sleeve at their default positions in readiness for the next cycle. Any overshoot of the sleeve or the piston valve is limited by the springs 41 and 32 while the orifices 27 and 29 are sized to control the velocity of the sleeve and piston valve.

In view of the above, it is readily apparent that the structure of the present invention provides an improved metering valve which is not affected by differences in the inlet pressure, viscosity, or temperature of the oil entering the inlet, and has increased tolerance of contaminants in the oil. This is accomplished by directing inlet pressure to the opposite ends of the sleeve and the piston valve at their default positions and utilizing pressure generated force acting on the sleeve and piston valve as part of the valve actuating forces. Moreover, since the pressure differential between the opposite ends of both the sleeve and the piston valve is relatively small, leakage is minimal so that the sliding fit between the elements can be sized to make the metering valve more tolerant to contaminants.

Other aspects, objects, and advantages of this invention can be obtained from a study of the drawings, the disclosure, and the appended claims.

I claim:

1. A fluid metering valve for outputting a fixed volume of fluid per valve actuation comprising:

a body having a bore therein and an inlet and an outlet opening into the bore;

a cylindrical sleeve slidably disposed within the bore and having a radial port continuously communicating with the inlet;

a piston valve slidably disposed within the sleeve and cooperating therewith to define a chamber in the body;

first means for resiliently biasing the sleeve to a default position blocking the chamber from the outlet and for biasing the piston to a default position communicating the radial port with the chamber;

second means for resiliently establishing the default position of the sleeve; and third means for establishing the default position of the piston valve.

2. The fluid metering valve of claim 1 wherein the first means includes spring means for biasing the piston valve away from the chamber and the sleeve toward the chamber.

3. The fluid metering valve of claim 2 wherein the spring means includes a first spring disposed between the sleeve and the piston valve.

4. The fluid metering valve of claim 3 wherein the second means includes an annular member engaging the body and disposed to be engaged by the sleeve, and a second spring disposed between the body and the annular member in a preloaded condition to resiliently resist movement of the sleeve toward the chamber.

5. The fluid metering valve of claim 4 wherein the preload of the second spring is greater than the biasing force exerted on the sleeve by the first spring.

6. The fluid metering valve of claim 4 wherein the third means includes another annular member engaging the body and disposed to be engaged by the piston valve, and a third spring disposed between the body and the other annular member in a preloaded condition to resiliently resist movement of the piston valve toward the other chamber.

7. The fluid metering valve of claim 4 including another chamber in the body at the opposite end of the bore defined by the piston valve and the sleeve, and a passage continuously communicating the inlet with the other chamber.

8. The fluid metering valve of claim 7 wherein the sleeve includes an annular groove therein continuously communicating with the inlet and the radial port.

9. The fluid metering valve of claim 4 including a force motor attached to the body and having a plunger disposed for engagement with the piston valve.

10. The fluid metering valve of claim 9 wherein the force motor is a solenoid.

11. The fluid metering valve of claim 9 wherein the third means includes the plunger of the force motor.

* * * * *